US012376618B2

(12) United States Patent
Ferrie et al.

(10) Patent No.: US 12,376,618 B2
(45) Date of Patent: Aug. 5, 2025

(54) SMOKING SUBSTITUTE CONSUMABLE

(71) Applicant: Imperial Tobacco Limited

(72) Inventors: Kate Ferrie, Liverpool (GB); Edward Ross Shenton, Liverpool (GB); John Williams, Liverpool (GB); Jill Jones, Liverpool (GB); Christopher Lord, Liverpool (GB)

(73) Assignee: Imperial Tobacco Limited, Bristol (GB)

( * ) Notice: Subject to any disclaimer, the term of this patent is extended or adjusted under 35 U.S.C. 154(b) by 910 days.

(21) Appl. No.: 17/221,288

(22) Filed: Apr. 2, 2021

(65) Prior Publication Data

US 2021/0219597 A1 Jul. 22, 2021

Related U.S. Application Data

(63) Continuation of application No. PCT/EP2019/076688, filed on Oct. 2, 2019.

(30) Foreign Application Priority Data

| | | |
|---|---|---|
| Oct. 3, 2018 | (GB) | 1816120 |
| Oct. 29, 2018 | (GB) | 1817560 |
| Feb. 22, 2019 | (EP) | 19020084 |

(51) Int. Cl.
*A24B 15/16* (2020.01)
*A24B 15/30* (2006.01)
(Continued)

(52) U.S. Cl.
CPC ..... *A24B 15/303* (2013.01); *A24B 15/16* (2013.01); *A24B 15/403* (2013.01); *A24F 40/20* (2020.01); *A24F 40/40* (2020.01)

(58) Field of Classification Search
None
See application file for complete search history.

(56) References Cited

U.S. PATENT DOCUMENTS 2,109,200 A * 2/1938 Leary ..... A24C 5/39 131/109.2
3,188,924 A 6/1965 Davey et al.
(Continued)

FOREIGN PATENT DOCUMENTS

CA 2875167 A1 12/2013
CN 105996119 A 10/2016
(Continued)

OTHER PUBLICATIONS

Erikas Simonavicius et al, "Conclusions", Tobacco Control, Sep. 4, 2018.
(Continued)

*Primary Examiner* — Philip Y Louie
*Assistant Examiner* — Madeleine P Delacruz
(74) *Attorney, Agent, or Firm* — DUNLAP CODDING, P.C.

(57) ABSTRACT

An aerosol-forming article (e.g. a heat-not-burn consumable) comprising an aerosol-forming substrate formed of a plurality of longitudinally-aligned, elongate shreds of plant material, wherein the plant material comprises at least one cannabinoid compound selected from cannabidiol (CBD) and its derivatives/homologues, cannabigerol (CBG) and its derivatives/homologues, cannabinol (CBN) and its derivatives/homologues, tetrahydrocannabinol (THC) and its derivatives/homologues, cannabicyclol (CBL) and its derivatives/homologues, cannabichromene (CBC) and its derivatives/homologues, cannabielsoin (CBE) and its derivatives/homologues, cannabicitran (CBT) and its derivatives/homologues.

8 Claims, 9 Drawing Sheets

(51) Int. Cl.

| | |
|---|---|
| ***A24B 15/40*** | (2006.01) |
| ***A24D 1/18*** | (2006.01) |
| ***A24D 1/20*** | (2020.01) |
| ***A24F 40/20*** | (2020.01) |
| ***A24F 40/40*** | (2020.01) |

(56) References Cited

U.S. PATENT DOCUMENTS

| | | | | |
|---|---|---|---|---|
| 3,242,925 | A | 3/1966 | Sterne | |
| 4,168,712 | A * | 9/1979 | Labbe | A24D 3/04 131/84.1 |
| 2015/0223515 | A1 | 8/2015 | McCullough | |
| 2016/0166786 | A1 | 6/2016 | Kinzer | |
| 2016/0331913 | A1 | 11/2016 | Bourque | |
| 2017/0237748 | A1 | 9/2017 | Klipfel et al. | |
| 2017/0273348 | A1 | 9/2017 | Klipfel et al. | |
| 2017/0273357 | A1 | 9/2017 | Barbuck | |
| 2018/0116274 | A1* | 5/2018 | Zuchuat | A24B 13/00 |
| 2019/0022158 | A1 | 1/2019 | Greenbaum et al. | |
| 2021/0307383 | A1* | 10/2021 | Davis | A24B 15/167 |

FOREIGN PATENT DOCUMENTS

| | | | | |
|---|---|---|---|---|
| CN | 205794794 | U | 12/2016 | |
| CN | 205831054 | U | 12/2016 | |
| CN | 106418658 | A | 2/2017 | |
| CN | 106954893 | A | 7/2017 | |
| CN | 107048469 | A | 8/2017 | |
| CN | 107536100 | A | 1/2018 | |
| CN | 108185517 | A | 6/2018 | |
| EP | 0280262 | A3 | 8/1988 | |
| EP | 0299272 | A3 | 1/1989 | |
| EP | 3075266 | A1 | 10/2016 | |
| EP | 3417724 | A1 | 12/2018 | |
| GB | 795534 | A | 5/1958 | |
| GB | 2233874 | A | 1/1991 | |
| GB | 2553773 | A | 3/2018 | |
| WO | WO2015/166245 | A2 | 11/2015 | |
| WO | WO2015/193031 | A1 | 12/2015 | |
| WO | WO2016/023965 | A1 | 2/2016 | |
| WO | WO2016/178098 | A2 | 11/2016 | |
| WO | WO2016/193147 | A1 | 12/2016 | |
| WO | WO2017/097840 | A1 | 6/2017 | |
| WO | WO2017/207586 | A1 | 12/2017 | |
| WO | WO-2019030277 | A1 * | 2/2019 | A24B 15/12 |
| WO | WO2020/070182 | A1 | 4/2020 | |
| WO | WO2020/070184 | A1 | 4/2020 | |

OTHER PUBLICATIONS

International Search Report and Written Opinion, mailed Dec. 13, 2019, in PCT/EP2019/076688, filed Oct. 2, 2019.

European Patent Office acting as the International Search Authority; International Search Report regarding PCT/EP2019/079187, filed Oct. 25, 2019; dated Feb. 6, 2020.

European Patent Office acting as the International Search Authority; International Search Report regarding PCT/EP2019/076682, filed Oct. 2, 2019; dated Jan. 23, 2020.

European Patent Office acting as the International Search Authority; International Search Report regarding PCT/EP2019/079186, filed Oct. 25, 2019, dated Feb. 11, 2020.

European Patent Office; Extended European Search Report in EP19020084.0 filed Feb. 22, 2019, dated Aug. 19, 2021.

UK Intellectual Property Office; Combined Search and Examination Report in GB1817578.6, filed Oct. 29, 2018, dated Apr. 12, 2019.

UK Intellectual Property Office; Combined Search and Examination Report in GB1817560.4, filed Oct. 29, 2018, dated Mar. 13, 2019.

UK Intellectual Property Office; Combined Search and Examination Report in GB1817559.6, filed Oct. 29, 2018, dated Mar. 6, 2019.

UK Intellectual Property Office; Combined Search and Examination Report in GB1816120.8, filed Oct. 3, 2018, dated Mar. 6, 2019.

* cited by examiner

FIG 7A
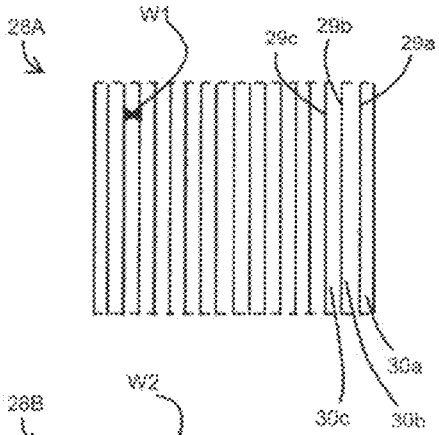
FIG 8
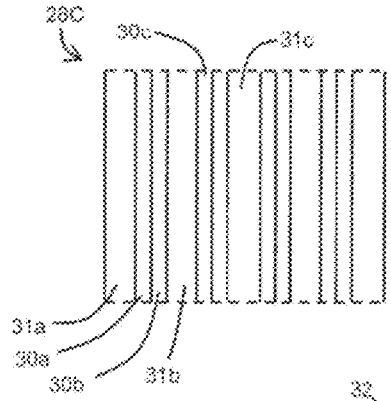
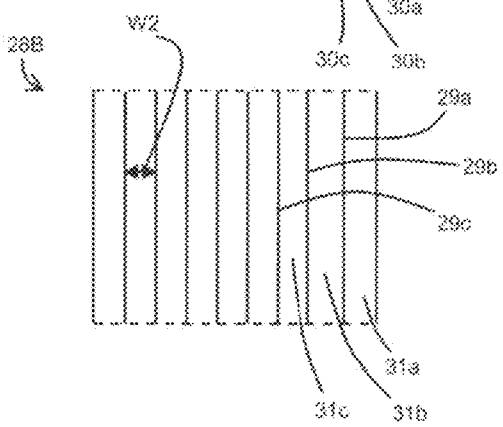
FIG 7B
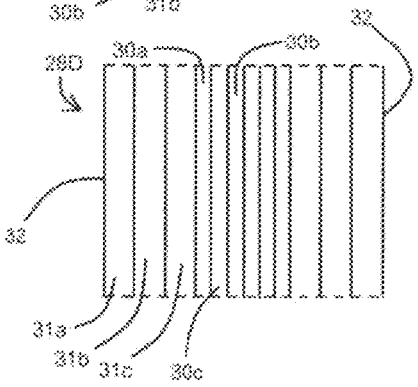
FIG 9

SMOKING SUBSTITUTE CONSUMABLE

CROSS-REFERENCE/INCORPORATION BY REFERENCE

This application is a continuation of International Application No. PCT/EP19/076688, filed Feb. 10, 2019; which claims benefit of GB Application No. 1816120.8, filed Oct. 3, 2018, and also claims benefit of GB Application No. 1817560.4, filed Oct. 29, 2018, and also claims the benefit of EP Application No. 19020084.0, filed on Feb. 22, 2019. The entire content of International Application No. PCT/EP19/076688 is hereby incorporated herein by reference.

FIELD OF THE DISCLOSURE

The present disclosure relates to an article/consumable for use in a smoking substitute system and particularly, although not exclusively, to a heat-not-burn (HNB) consumable, wherein the article/consumable comprises shreds of plant material. The present disclosure also relates to a web of plant material, a method of forming the web of plant material and a method for forming the article/consumable.

BACKGROUND

Ingestion of the plant material, cannabis (also known as marijuana or hashish) is widely known for both medicinal and recreational purposes. In some countries, recreational use of cannabis has been legalized, or is officially tolerated.

Cannabis comprises numerous (phyto-)cannabinoids some of which can act on human cannabinoid receptors ($CB_1$ and $CB_2$) to affect physiological processes such as appetite, mood, stress response and muscular/joint pain relief.

Ingestion of cannabis is typically through smoking (either alone or mixed with tobacco) and is considered to expose a smoker to potentially harmful substances. It is generally thought that a significant amount of the potentially harmful substances are generated through the heat caused by the burning and/or combustion of the cannabis (and tobacco) and the constituents of the burnt cannabis (and tobacco) in the smoke itself.

Conventional cannabis smoking articles often referred to as "joints" are typically rolled by hand by the user and comprise a roughly cylindrical wad of dried cannabis leaves/buds/flowers which is surrounded by a paper wrapper. A filter may or may not be included, axially aligned in an abutting relationship with the wrapped cannabis wad. A conventional cannabis smoking article of this type is used by lighting the end opposite to the filter, and burning the cannabis wad. The smoker receives mainstream smoke into their mouth by drawing on the filter end of the article.

Combustion of organic material such cannabis is known to produce potentially harmful by-products. Furthermore, some medicinal effects of cannabis are decreased by combustion which can deactivate certain cannabinoids. There have been proposed various smoking substitute systems (or "substitute smoking systems") in order to avoid the smoking of cannabis.

Smoking substitute systems for cannabis include heat-not-burn (HNB) systems in which a heater heats ground, chopped or loose leaf cannabis plant material contained within a sealed container pod or capsule to produce an aerosol (also referred to as a "vapour") that is drawn into the lungs through the mouth (inhaled) and then exhaled. The inhaled aerosol typically bears cannabinoids without, or with fewer of, the odour and health risks associated with traditional cannabis smoking.

However, these known cannabis smoking substitute systems do not provide a substitute for the rituals of smoking which is important especially for recreational users.

There is a need for improved design of cannabis HNB smoking substitute systems to enhance the user experience.

The present disclosure has been devised in light of the above considerations.

SUMMARY OF THE DISCLOSURE

At its most general, the present disclosure relates to an aerosol-forming article e.g. a consumable for use in a smoking substitute system and particularly, although not exclusively, to a heat-not-burn (HNB) consumable, wherein the article/consumable comprises a substrate having shreds of plant material comprising at least one cannabinoid. The present disclosure also relates to a web of plant material comprising at least one cannabinoid, a method for forming the web of plant material comprising at least one cannabinoid, and a method for forming the article.

Accordingly, in a first aspect, there is provided an aerosol-forming article comprising an aerosol-forming substrate formed of a plurality of longitudinally-aligned, elongate shreds of plant material, wherein the plant material comprises at least one cannabinoid.

By providing an article having a substrate formed of a plurality of longitudinally-aligned, elongate shreds of cannabinoid-containing plant material (e.g. cannabis), an elongate article resembling a conventional smoking article can be provided. Unlike the known pods containing ground cannabis, the elongated articles provide the user with an experience akin to a conventional smoking experience.

Optional features will now be set out. These are applicable singly or in any combination with any aspect.

The aerosol-forming substrate is capable of being heated to release at least one cannabinoid compound (e.g. a mixture of two or more cannabinoid compounds) that can form an aerosol.

Cannabinoid compounds include phyto-cannabinoids which include:

- cannabidiol (CBD) and its derivatives/homologues (e.g. cannabidiol mono(m)ethyl ether, cannabidivarin (CBDV), cannabidiorcol, cannabidiolic acid, cannabidivarinic acid);
- cannabinodiol (CBND) and its derivatives/homologues (e.g. carrabinodivarin);
- cannabigerol (CBG) and its derivatives/homologues (e.g. cannabigerol mono(m)ethyl ether cannabinerolic acid A, cannabigerovarin, cannabigerolic acid A, cannabigerolic acid Ar mono(m)ethyl ether, cannabigerovarinic acid A);
- cannabinol (CBN) and its derivatives/homologues (e.g. cannabivarin/cannabivarol (CBV), cannabiorcol, cannabinolic acid, cannabinol (m)ethyl ester);
- tetrahydrocannabinol (THC) and its derivatives/homologues (e.g. tetrahydrocannabivarin (THCV), tetrahydrocannabiorcol, tetrahydrocannabinolic acid A/B, tetrahydrocannabivarinic acid A, tetrahydrocannabiorcolic acid A/B, isotetrahydrocannabinol, isotetrahydrocannabivarin);
- cannabicyclol (CBL) and its derivatives/homologues (e.g. cannabicyclolic acid, cannabicyclovarin);

cannabichromene (CBC) and its derivatives/homologues (e.g. cannabichromenic acid A, cannabichromevarin (CBCV), cannabichromevarinic acid A);

cannabielsoin (CBE) and its derivatives/homologues (e.g. cannabielsoic acid A/B, cannabiglendol, dehydrocannabifuran, cannabifuran);

cannabicitran (CBT) and its derivatives/homologues;

cannabitriol and its derivatives/homologues (e.g. ethyl cannabitriol, dihydroxy-tetrahydrocannabinol, cannabidiolic acid A cannabitriol ester, dihydroxy-hexahydrocannabinol (cannabiripsol), cannabitetrol, oxo-tetrahydrocannabinol); and cannabichromanone (CBCN) and its derivatives/homologues (e.g. cannabicoumaronone).

In some embodiments, the cannabinoid compound is selected from at least one of cannabidiol (CBD) and its derivatives/homologues e.g. cannabiodiol-Csubscript (CBD-$C_5$), cannabidiol-$C_4$ (CBD-$C_4$), cannabidiol mono(m) ethyl ether (CBDM-$C_5$), cannabidivarin (CBDV-$C_3$), cannabidiorcol (CBD-$C_1$), cannabidiolic acid (CBDA-$C_5$), cannabidivarinic acid (CBDVA-$C_3$).

In some embodiments, the cannabinoid compound is selected from at least one of tetrahydrocannabinol (THC) and its derivatives/homologues, e.g. $\Delta^9$-tetrahydrocannabinol ($\Delta^9$-THC-$C_5$/cis-$\Delta^9$-THC-$C_5$), $\Delta^8$-tetrahydrocannabinol ($\Delta^8$-THC-$C_5$), $\Delta^8$-tetrahydrocannabinolic acid A ($\Delta^8$-THCA-$C_5$ A), $\Delta^9$-tetrahydrocannabinol-$C_4$ ($\Delta^9$-THC-$C_4$), $\Delta^9$-tetrahydrocannabivarin ($\Delta^9$-THCV-$C_3$), $\Delta^9$-tetrahydrocannabiorcol ($\Delta^9$-THCO-$C_1$), $\Delta^9$-tetrahydrocannabinolic acid A ($\Delta^9$-THCA-$C_5$ A), $\Delta^9$-tetrahydrocannabinolic acid B ($\Delta^9$-THCA-$C_5$ B), $\Delta^9$-tetrahydrocannabinolic acid-$C_4$ A and/or B ($\Delta^9$-THCA-$C_4$ A and/or B), $\Delta^9$-tetrahydrocannabivarinic acid A ($\Delta^9$-THCVA-$C_3$ A), $\Delta^9$-tetrahydrocannabiorcolic acid A and/or B ($\Delta^9$-THCOA-$C_1$ A and/or B), isotetrahydrocannabinol and isotetrahydrocannabivarin.

The total amount of cannabinoid compounds in the substrate may be at least 200 mg; for example, it may be at least 250 mg, at least 300 mg, at least 400 mg, at least 500 mg. In some cases, lower amounts may be preferred. The total amount of cannabinoid compounds in the substrate may therefore be at least 10 mg, at least 20 mg, at least 30 mg, at least 40 mg, at least 50 mg, at least 75 mg, at least 100 mg.

In some cases, it may be desirable to limited the total amount of cannabinoid compounds, which may be not more than 200 mg, not more than 175 mg, not more than 150 mg, not more than 125 mg, not more than 100 mg, not more than 75 mg, not more than 50 mg, not more than 40 mg, not more than 30 mg, not more than 20 mg, not more than 10 mg. In some cases, the total amount of the cannabinoid compounds may be not more than 5 mg.

Where THC is included, either as one cannabinoid compound in a mixture or as the only cannabinoid, the total of amount of THC may be limited. In some cases, the total amount of THC in the substrate is not more than 100 mg, not more than 75 mg, not more than 50 mg, not more than 40 mg, not more than 30 mg, not more than 20 mg, not more than 15 mg, not more than 10 mg, not more than 5 mg, not more than 3 mg. In some cases, the amount of THC may be 0.1 to 30 mg, for example 1 to 30 mg, for example 1 to 20 mg, for example 1 to 10 mg, for example 1 to 5 mg, for example 1 to 3 mg.

The cannabinoid-containing plant material may comprise cannabis plant material including for example,

*Cannabis sativa, Cannabis indica* and *Cannabis rudealis.*

The cannabinoid-containing plant material may comprise *Echinacea purpurea, Echinacea angustifolia, Acmella oleracea, Helichrysum umbraculigerum*, or *Radula marginata*. This also includes blends of the above mentioned plant material.

Preferably the cannabinoid-containing plant material is cannabis. The cannabinoid-containing plant material may comprise one or more of leaf cannabis, homogenised cannabis or reconstituted cannabis (e.g. slurry recon or paper recon).

The cannabinoid-containing (e.g. cannabis) plant may be a traditional strain, or may be a strain bred or other modified (e.g. genetically) to produce certain levels of some cannabinoids compounds, e.g. low levels of THC or high levels of THC.

Any suitable parts of the cannabinoid-containing plant may be used. Thus the cannabinoid-containing plant material may comprise leaves, stems, roots, bark, seeds, buds and flowers (which may be cured).

The plant material preferably comprises cannabis plant material (such as that described above) as a major component i.e. the plant material preferably comprises at least 40 wt % cannabis plant material, e.g. at least 50 wt % cannabis plant material or at least 60 wt % cannabis plant material such as at least 70 wt % or 80 wt % cannabis plant material, for example at least 90 wt % cannabis plant material. In some embodiments, the plant material in the substrate is exclusively (i.e. 100 wt %) cannabis plant material.

The aerosol-forming substrate may comprise at least 50 wt % plant material, e.g. at least 60 wt % plant material e.g. around 65 wt % plant material. The aerosol-forming substrate may comprise 80 wt % or less plant material e.g. 75 or 70 wt % or less plant material.

The aerosol-forming substrate may comprise gathered shreds of cannabinoid-containing (e.g. cannabis) plant material formed from a sheet/web of homogenized (e.g. paper/slurry recon) cannabinoid-containing (e.g. cannabis) plant material.

In some embodiments, the sheet/web of cannabinoid-containing (e.g. cannabis) plant material used to form the aerosol-forming substrate has a sheet weight (grammage) greater than or equal to 100 g/$m^2$, e.g. greater than or equal to 110 g/$m^2$ such as greater than or equal to 120 g/$m^2$.

The sheet/web of cannabinoid-containing (e.g. cannabis) plant material may have a grammage of less than or equal to 300 g/$m^2$, e.g. less than or equal to 250 g/$m^2$ or less than or equal to 200 g/$m^2$.

The sheet/web of cannabinoid-containing (e.g. cannabis) plant material may have a grammage of between 120 and 190 g/$m^2$.

In some embodiments, the aerosol-forming substrate may be formed from a sheet/web of cannabinoid-containing (e.g. cannabis) plant material having a plurality of first elongate shreds and a plurality of second elongate shreds, each first shred having longitudinal edges spaced by a first transverse width and each second shred having longitudinal edges spaced by a second transverse width, wherein the first transverse width is different to the second transverse width. Such a web is described below in more detail.

In these embodiments, the aerosol-forming substrate comprises a plurality of first elongate shreds of plant material and a plurality of second elongate shreds of plant material, each first shred having longitudinal edges spaced by a first transverse width and each second shred having longitudinal edges spaced by a second transverse width, wherein the first transverse width is different to the second transverse width and wherein the first and/or second shreds is/are formed of the cannabinoid-containing (e.g. cannabis) plant material.

The first shreds may be interspersed with the second shreds in a way that the first and second shreds are distributed generally evenly throughout the substrate. That is, the number (and/or weight and/or volume) of first shreds may be substantially equal to the number (and/or weight and/or volume) of second shreds throughout the aerosol-forming substrate.

The first and second shreds may be unevenly distributed throughout the substrate. For example, a first region of the substrate may comprise a greater proportion (e.g. by number) of first shreds than of the second shreds. The first region of the substrate may comprise a greater proportion, by weight, volume and/or by number, of first shreds than of the second shreds. The first region may predominantly, or solely, comprise first shreds (i.e. the first region may not comprise any second shreds). The first region may be at, or proximate to, a periphery of the substrate.

The aerosol-forming substrate may further comprise a second region comprising a greater proportion of second shreds than of the first shreds. The second region of the substrate may comprise a greater proportion, by weight, volume and/or number, of second shreds than of the first shreds. The second region may predominantly, or solely, comprise second shreds (i.e. the second region may not comprise any first shreds). The second region may be disposed at a central, axial portion of the substrate, which is spaced from a periphery of the substrate.

The differences in the composition of the first and second regions may result in different (e.g. heat transfer) characteristics at those regions. Thus, the regions may be positioned so as to provide a desired effect in regards to e.g. transfer of heat. For example, it may be desirable to have a consistent temperature across the substrate when heated. In this case, regions that are proximate to a heating element (when positioned in the substrate) may be formed in such a way that they transfer heat more rapidly (e.g. to regions that are distal from the heating element).

Where the substrate is cylindrical, the first region may extend circumferentially and proximate to a 20 circumferential surface of the cylinder (i.e. such that the first region has a generally tubular shape). The second region may extend along a substantially central axis of the cylinder, (i.e. so as to define a core of a generally cylindrical shape). In this respect, the proportion of first shreds relative to the second shreds may vary in a radial direction of the substrate. In some cases, wider shreds may result in wider air paths (i.e. formed between the shreds) in the substrate, which may lead to a cooler portion of the substrate where the wider shreds are located. Where the wider shreds are located at the outer (peripheral) portion of the substrate, the outer portion (and outer surface) of the substrate may be cooler.

Alternatively or additionally, the proportion of first shreds relative to the second shreds may vary in an axial direction with respect to the substrate. In this case, the first region of the substrate (having a greater proportion of first shreds) and the second region of the substrate (having greater proportion of second shreds) will be axially adjacent one another. For example, the first region may be at the axial upstream end of the substrate and the second region may be at the axial downstream end of the substrate.

The variation of the proportion of the first and second shreds (e.g. radially or axially) may vary gradually, or may vary abruptly.

There may be an intermediate region containing an equal proportion, by weight, volume and/or number of first and second shreds. This may be radially interposed between the radially segregated first and second regions or axially interposed between the axially segregated first and second regions.

The first transverse width may be greater than the second transverse width. Alternatively, the second transverse width may be greater than the first transverse width.

The ratio of the greater of the first and second transverse width to the lesser of the first and second transverse width may be between 1.5:1 and 3:1. The ratio may be between 1.5:1 and 2.5:1. Preferably, the ratio is 2:1.

The lesser of the first and second transverse width may be between 0.5 mm and 2 mm, preferably between 0.8 mm and 1.2 mm, e.g. around 1 mm. The greater of the first and second transverse width may be between 1.5 mm and 3 mm, preferably, between 1.8 mm and 2.2 mm, e.g. around 2 mm.

The aerosol-forming substrate may further comprise any number of pluralities of further shreds having a further transverse width different to both the first and second transverse widths. In this respect, the aerosol forming substrate may comprise any number of further regions, each further region have a greater proportion of further shreds.

In some embodiments, the aerosol-forming substrate may be formed from a sheet/web of cannabinoid-containing (e.g. cannabis) plant material having a plurality of longitudinally-extending shreds wherein there is a plurality of transverse bridge portions each extending between and joining two or more of the shreds, wherein none of the bridge portions extend across the entire transverse width of the web. Such a web is described below in more detail.

In these embodiments the aerosol-forming substrate comprises a plurality of longitudinally-aligned elongate shreds (of equal or differing transverse widths) of cannabinoid-containing (e.g. cannabis) plant material wherein there is a plurality of transverse bridge portions each extending between and joining two or more of the shreds.

Each transverse bridge portion may span ten or fewer e.g. nine or fewer e.g. eight or seven or six or five or four or three or fewer immediately adjacent shreds of cannabinoid-containing (e.g. cannabis) plant material. Preferably each transverse bridge portion spans only two adjacent shreds.

The substrate may comprise a plurality of shreds all having an equal width i.e. between 0.5 and 2 mm, preferably between 0.5 and 1.5 mm e.g. around 1 mm.

Where the transverse bridge portion spans only two adjacent shreds of plant material, the transverse bridge portion has a transverse dimension of between 1 mm and 4 mm, preferably around 2 mm.

The substrate may comprise shreds having differing transverse widths as described above for previous embodiments.

The aerosol-forming article is preferably a heat-not-burn (HNB) consumable.

The aerosol-forming substrate may be located at an upstream axial end of the article/consumable.

As used herein, the terms "upstream" and "downstream" are intended to refer to the flow direction of the vapour/aerosol i.e. with the downstream end of the article/consumable being the mouth end or outlet where the aerosol exits the article/consumable for inhalation by the user. The upstream end of the article/consumable is the opposing end to the downstream end.

The aerosol-forming substrate may be at least partly circumscribed by a wrapping layer e.g. a paper wrapping layer.

The aerosol-forming substrate may be formed in a substantially cylindrical shape such that the article/consumable resembles a conventional cigarette. It may have a diameter of between 5 and 10 mm e.g. between 6 and 9 mm or 6 and 8 mm e.g. around 7 mm. It may have an axial length of between 10 and 15 mm e.g. between 11 and 14 mm such as around 12 or 13 mm. The elongate shreds will be longitudinally aligned with the axial length of the substrate.

The article/consumable may comprise one or more of a hollow bore element, a filter element, a spacer element and/or a cooling element downstream of the substrate.

The hollow bore element comprises a hollow bore which extends the axial length of the hollow bore element.

The hollow bore element may be a terminal hollow bore element at the downstream/mouth end of the article/consumable. In these embodiments, the hollow bore terminates at the downstream/mouth end of the article/consumable.

The hollow bore element may be an upstream hollow bore element i.e. upstream of the downstream/mouth end of the article/consumable (but downstream of the substrate).

The article/consumable may comprise both a terminal and upstream hollow bore element. The terminal and upstream hollow bore elements may be axially adjacent one another or may be axially spaced. The upstream hollow bore element may be axially adjacent i.e. immediately downstream of the substrate.

The or each hollow bore element may have an axial bore i.e. aligned with the axis of the hollow bore element. The or each hollow bore may have a bore diameter of between 1 and 5 mm, e.g. between 2 and 4 mm or between 2 and 3 mm.

The or each hollow bore element may be formed of a smoke permeable (porous) material such as cellulose acetate or polypropylene tow, paper or plant material or may be formed of smoke impermeable (non-porous) material e.g. non-porous plastics material.

The or each hollow bore element may be circumscribed with a plug wrap e.g. a paper plug wrap.

The upstream hollow bore element may be at least partly (e.g. entirely) circumscribed by the (paper) wrapping layer.

The terminal hollow bore element (at the downstream end of the article/consumable) may be joined to the adjacent, upstream elements forming the article/consumable by a circumscribing tipping layer e.g. a tipping paper layer. The tipping paper may have an axial length longer than the axial length of the terminal hollow bore element such that the tipping paper completely circumscribes the terminal hollow bore element plus the wrapping layer surrounding any adjacent upstream element.

The or each hollow bore element may have a substantially cylindrical shape with a diameter substantially matching the diameter of the aerosol-forming substrate (with or without its associated wrapping layer). The axial length of the or each hollow bore element may be less than 20 mm, e.g. between 8 and 15 mm, for example between 9 and 13 mm e.g. between 10 and 12 mm.

The filter element may be a terminal filter element at the downstream/mouth end of the article/consumable.

The filter element may be an upstream filter element i.e. upstream of the downstream/mouth end of the article/consumable (but downstream of the substrate).

The article/consumable may comprise both a terminal and upstream filter element. The terminal and upstream filter elements may be axially adjacent one another or may be axially spaced. The upstream filter element may be axially adjacent i.e. immediately downstream of the substrate.

The or each filter element is of a smoke permeable (porous) material such as cellulose acetate or polypropylene tow, paper or plant material.

The or each filter element may be circumscribed with a plug wrap e.g. a paper plug wrap.

The upstream filter element may be at least partly (e.g. entirely) circumscribed by the (paper) wrapping layer.

The terminal filter element (at the downstream end of the article/consumable) may be joined to the adjacent, upstream elements forming the article/consumable by a circumscribing tipping layer e.g. a tipping paper layer. The tipping paper may have an axial length longer than the axial length of the terminal filter element such that the tipping paper completely circumscribes the terminal filter element plus the wrapping layer surrounding any adjacent upstream element.

The or each filter element may have a substantially cylindrical shape with a diameter substantially matching the diameter of the aerosol-forming substrate (with or without its associated wrapping layer). The axial length of the or each filter element may be less than 20 mm, e.g. between 8 and 15 mm, for example between 9 and 13 mm e.g. between 10 and 12 mm.

In some embodiments, there may be an upstream hollow bore element and a terminal filter element.

In some embodiments, the article/consumable may comprise an aerosol-cooling element which is adapted to cool the aerosol generated from the aerosol-forming substrate (by heat exchange) before being inhaled by the user.

The aerosol-cooling element will be downstream from the aerosol-forming substrate. For example, it may be between the aerosol-forming substrate and the terminal hollow bore/filter element and/or between the terminal and upstream hollow bore/filter elements. The aerosol cooling element may be at least partly (e.g. completely) circumscribed by the (paper) wrapping layer.

The aerosol-cooling element may be formed of a plastics material selected from the group consisting of polylactic acid (PLA), polyvinyl chloride (PVC), polyethylene (PE) and polyethylene terephthalate (PET). The aerosol-cooling element may be formed of a crimped/gathered sheet of material to form a structure having a high surface area with a plurality of longitudinal channels to maximize heat exchange and cooling of the aerosol.

The aerosol cooling element may have an external diameter of between 5 and 10 mm e.g. between 6 and 9 mm or 6 and 8 mm, e.g. around 7 mm. It may have an axial length of between 10 and 15 mm e.g. between 12 and 14 mm or 13 and 14 mm e.g. around 14 mm.

The article/consumable may comprise a spacer element that defines a space or cavity or chamber between the aerosol-forming substrate and the downstream end of the article/consumable. The spacer acts to allow both cooling and mixing of the aerosol. It may be provided between the aerosol-forming substrate and the terminal hollow bore/filter element and/or between the terminal and upstream hollow bore/filter elements.

The spacer element may comprise a tubular element e.g. a cardboard tube. The spacer element may be at least partly (e.g. entirely) circumscribed by the (paper) wrapping layer.

The spacer element may have an external diameter of between 5 and 10 mm e.g. between 6 and 9 mm or 6 and 8 mm, e.g. around 7 mm. It may have an axial length of between 10 and 15 mm e.g. between 12 and 14 mm or 13 and 14 mm e.g. around 14 mm.

In a second aspect, there is provided a web of reconstituted cannabinoid-containing (e.g. cannabis) plant material.

The web of reconstituted cannabinoid-containing (e.g. cannabis) plant material may comprise slurry recon or paper recon cannabinoid-containing (e.g. cannabis) plant material.

The cannabinoid-containing plant material may be as described above for the first aspect, and, as will be described further below, the web of the second aspect may be used to form the article/consumable of the first aspect.

For example, the plant material in the web preferably comprises cannabis plant material (such as that described above for the first aspect) as a major component i.e. the plant material preferably comprises at least 40 wt % cannabis plant material, e.g. at least 50 wt % cannabis plant material or at least 60 wt % cannabis plant material such as at least 70 wt % or 80 wt % cannabis plant material, for example at least 90 wt % cannabis plant material. In some embodiments, the plant material in the web is exclusively (i.e. 100 wt %) cannabis plant material.

The web of cannabinoid-containing (e.g. cannabis) plant material may have a transverse dimension equal to or less than 200 mm, e.g. equal to or less than 150 mm such as equal or less than 140 mm.

The web of cannabis material may have a transverse dimension equal to or greater than 100 mm, e.g. greater than 110 mm such as greater than 120 mm.

The web of cannabinoid-containing (e.g. cannabis) plant material may have a transverse dimension of around 130 mm.

The web of cannabinoid-containing (e.g. cannabis) plant material may have a sheet weight (grammage) greater than or equal to 100 $g/m^2$, e.g. greater than or equal to 110 $g/m^2$ such as greater than or equal to 120 $g/m^2$.

The web of cannabinoid-containing (e.g. cannabis) plant material may have a sheet weight (grammage) less than or equal to 300 $g/m^2$ e.g. less than or equal to 250 $g/m^2$ or less than or equal to 200 $g/m^2$.

The web of cannabinoid-containing (e.g. cannabis) plant material may have a sheet weight (grammage) of between 120 and 190 $g/m^2$.

The web may comprise a plurality of longitudinally-aligned, elongate shreds of cannabinoid-containing plant material.

In some embodiments, the web of cannabinoid-containing (e.g. cannabis) plant material comprises a plurality of first elongate shreds and a plurality of second elongate shreds, each first shred having longitudinal edges spaced by a first transverse width and each second shred having longitudinal edges spaced by a second transverse width, wherein the first transverse width is different to the second transverse width.

The web may have a first lateral end and an opposing second lateral end with the shreds running longitudinally between the first and second lateral ends.

References to "the transverse width" and uses of the terms "transverse" and/or "transversely" are intended to refer to a direction which is perpendicular to the longitudinal direction i.e. perpendicular to the direction in which the shreds of cannabinoid-containing (e.g. cannabis) plant material extend.

The second shreds may be interspersed with the first shreds. The distribution of first and second shreds across the transverse width of the web of cannabinoid-containing (e.g. cannabis) plant material may be substantially even. For example, the first and second shreds may be arranged in an alternating pattern (e.g. one first shred followed by one second shred etc.). Similarly, a plurality (e.g. two, three, four, etc.) of first shreds may be followed by one or more (e.g. two, three, four, etc.) second shreds, and this pattern may repeat itself across the transverse width of the web.

The shreds may alternatively be distributed in a non-even manner. The first and second shreds may also be segregated from one another (i.e. non-interspersed). For example, the first shreds may be grouped together at a first side of the web, and the second shreds may be grouped together at a second, opposing, side of the web.

Alternatively, the first shreds may be split into two groups sandwiching the second shreds at the transverse centre of the web. Thus, in some embodiments, the web of cannabinoid-containing (e.g. cannabis) plant material may comprise one or more of said first shreds at opposing longitudinal edges of the web, and a plurality of said second shreds located at a central portion of the web between the longitudinal edges of the web. As is set forth above, the first transverse width may be greater than the second transverse width. Thus, the first shreds at the longitudinal edges of the web may be wider than the second shreds at the central portion of the web.

During manufacture of the web, the web may be passed over a plurality of rollers and, in some cases, there may be some (minor) difference in the transverse position of the web on those rollers. As a result, the web may bend slightly (in the transverse direction) from one roller to the next. This can put extra tension on the outer portions of the web, at the longitudinal edges of the web. Hence, the provision of wider (i.e. first) shreds at the longitudinal edges of the web may help to prevent breakage of the shreds when under this extra tension.

The different arrangements of shreds may result in differences in the structure of an aerosol-forming substrate when formed from the web of cannabinoid-containing (e.g. cannabis) plant material (e.g. by gathering of the web of cannabinoid-containing (e.g. cannabis) plant material). For example, a substrate formed from the web of cannabinoid-containing (e.g. cannabis) plant material may have regions in which the proportion of first shreds is greater than the proportion of second shreds (and vice-versa). Similarly, a substrate formed from the web may have regions that only include first shreds, and regions that only include second shreds. In this way, the arrangement of the first and second shreds in the web can be selected so as to provide a substrate with a particular structure and thus particular (e.g. heat transfer) characteristics.

In some embodiments, the web of cannabinoid-containing (e.g. cannabis) plant material comprises a plurality of longitudinally-extending shreds (of equal or differing transverse widths) wherein there is a plurality of transverse bridge portions each extending between and joining two or more of the shreds, wherein none of the bridge portions extend across the entire transverse width of the web.

The adjacent bridge portions may be longitudinally-spaced from one another. The longitudinal spacing between adjacent bridge portions results in adjacent bridge portions being unaligned in the transverse direction.

The adjacent transverse bridge portions may be completely unaligned in the transverse direction such that there is no longitudinal overlap of adjacent bridge portions in the transverse direction.

Each transverse bridge portion may span ten or fewer e.g. nine or fewer e.g. eight or seven or six or five or four or three or fewer immediately adjacent shreds of cannabinoid-containing (e.g. cannabis) plant material. Preferably each transverse bridge portion spans only two adjacent shreds of cannabinoid-containing (e.g. cannabis) plant material.

The web of cannabinoid-containing (e.g. cannabis) plant material may have a plurality of longitudinally-extending discontinuous slits dividing the plant material into the plurality of longitudinally-extending shreds, each discontinuous slit comprising a respective discontinuity forming the respective transverse bridge portion between adjacent shreds.

The discontinuity (or interruption) in a discontinuous slit results in a transverse bridge portion formed of un-slit plant material that joins adjacent shreds of t cannabinoid-containing (e.g. cannabis) plant material.

Upon progression along the transverse direction, adjacent bridge portions may get progressively closer to one of the lateral ends of the web. There may be an equal longitudinal spacing between the transverse bridge portions. In these embodiments, the transverse bridge portions are diagonally arranged/offset on the web of plant material.

Alternatively, each of the plurality of transverse bridge portions (other than the bridge portion at the transverse edge of the web) may be closer to one of the lateral ends of the web than its two adjacent bridge portions (i.e. than the two bridge portions on either side of it). In this way, the transverse bridge portions may be randomly arranged on the web of plant material. This longitudinal spacing of the bridge portions may lead to an arrangement where the plurality of bridge portions form a plurality of longitudinally spaced diagonal arrangements which adjacent bridge portions forming part of different diagonal arrangements.

As described above for previous embodiments, the web may have a first lateral end and an opposing second lateral end with the slits and shreds running longitudinally between the first and second lateral ends.

References to "the transverse direction" and uses of the terms "transverse" and/or "transversely" are intended to refer to a direction which is perpendicular to the longitudinal direction i.e. perpendicular to the direction in which the slits within the web of cannabinoid-containing (e.g. cannabis) plant material extend and perpendicular to the direction in which the shreds of cannabinoid-containing (e.g. cannabis) plant material extend.

The web of cannabinoid-containing (e.g. cannabis) plant material may comprise a first group of discontinuous slits wherein all transverse bridge portions within the first group are longitudinally spaced from one another. The first group of discontinuous slits may comprise 10 or fewer, e.g. 9 or fewer, such as 8 or 7 fewer, for example 6 or 5 or 4 transverse bridge portions.

The discontinuous slits in the first group of discontinuous slits may be immediately adjacent each other in a transverse direction.

Alternatively, there may be one or more continuous slit(s) (i.e. slit(s) without any discontinuities/transverse bridge portions) interposed between adjacent discontinuous slits in the first group of discontinuous slits. There may be a group of immediately adjacent continuous slits.

The web may further comprise a second group of discontinuous slits which may be spaced in a transverse direction from the first group of discontinuous slits by the group of continuous slits. The second group of discontinuous slits may be identical to the first group of discontinuous slits i.e. with the transverse bridge portions aligned in the transverse direction between the first and second group of discontinuous slits.

The group of continuous slits may include a greater number of slits than the groups(s) of discontinuous slits.

The transverse spacing between adjacent slits in the first and/or second group of discontinuous slits and/or between adjacent slits in the first group of continuous slits may be substantially equal.

The transverse spacing between the slits may be equal to greater than 0.5 mm. The transverse spacing between the slits may be equal to or less than 2 mm, e.g. equal to or less than 1.5 mm. The transverse spacing between the slits may be around 1 mm.

In this way, the web of cannabinoid-containing (e.g. cannabis) plant material preferably comprises a plurality of shreds of plant material all having an equal width i.e. between 0.5 and 2 mm, preferably between 0.5 and 1.5 mm e.g. around 1 mm.

Where the transverse bridge portion spans only two adjacent shreds of plant material, the transverse bridge portion has a transverse dimension of between 1 mm and 4 mm, preferably around 2 mm.

The web of cannabinoid-containing (e.g. cannabis) plant material may comprise shreds having differing transverse widths as described above for previous embodiments.

The longitudinal dimension of the discontinuity and thus the longitudinal dimension of the transverse bridge portions may be equal to or greater than 1 mm, e.g. equal to or greater than 2 mm or 3 mm. The longitudinal dimension of the discontinuity and thus the longitudinal dimension of the transverse bridge portions may be equal to or less than 6 mm, e.g. equal to or less than 5 mm. The longitudinal dimension of the discontinuity and thus the longitudinal dimension of the transverse bridge portions may be around 4 mm.

In a third aspect there is provided a method for forming a web of cannabinoid-containing (e.g. cannabis) plant material, the method comprising:

providing a sheet of cannabinoid-containing (e.g. cannabis) plant material, and dividing the sheet using a plurality of longitudinally-extending slits to form a plurality of first elongate shreds.

The cannabinoid-containing plant material may be as described above for the first aspect.

The longitudinally extending slits may be formed by passing the sheet through a pair of interdigitated transverse stacks of rotary cutting blades. In some embodiments, the method comprises dividing the sheet using the plurality of longitudinally-extending slits to form the plurality of first elongate shreds and a plurality of second elongate shreds, each first shred having longitudinal edges spaced by a first transverse width and each second shred having longitudinal edges spaced by a second transverse width, wherein the first transverse width is different to the second transverse width.

The rotary cutting blades are unevenly spaced so as to form the first and second shreds of respective different first and second transverse widths.

The sheet may be divided such that the (e.g. wider) first shreds are located and opposing longitudinal edges of the web and the (e.g. narrower) second shreds are located at a central portion of the web. The method may comprise passing the web over a plurality of rollers. Where this is the case, the wider first shreds at the longitudinal edges of the web may help the web to withstand extra tension imparted on the web by way of transverse movement of the web between rollers.

In some embodiments, the method comprises dividing the sheet by forming a plurality longitudinally-extending slits, wherein the slits are discontinuous such that the method further comprises leaving a plurality of un-slit transverse bridge portions each joining at least two adjacent shreds, wherein none of the bridge portions extend across the entire transverse width of the web.

The method may comprise leaving un-slit transverse bridge portions such that adjacent transverse bridge portions are longitudinally spaced relative to one another.

The method may comprise leaving un-slit transverse bridge portions between ten or fewer e.g. nine or fewer e.g. eight or seven or six or five or four or three or fewer immediately adjacent shreds of plant material. The method preferably comprises leaving un-slit transverse portions between only two adjacent shreds.

The method may comprise forming a first group of discontinuous slits and transverse bridge portions by passing the sheet of cannabinoid-containing (e.g. cannabis) plant material through a pair of interdigitated transverse stacks of rotary cutting blades wherein a plurality of blades within the interdigitated transverse stacks each comprise a respective notch, wherein the notches are circumferentially staggered relative to one another i.e. angularly spaced in a circumferential direction relative to one another.

Preferably the method comprises using a pair of interdigitated transverse stacks of rotary cutting blades wherein the notches are completely unaligned in the circumferential direction meaning that there is no overlap of the notches in the circumferential direction.

In this way, the notches in the cutting blades will form the discontinuities in the discontinuous slits and the circumferential off-setting of the notches will result in the resulting discontinuities/transverse bridge portions being off-set by a longitudinal spacing which will equal the circumferential spacing of the adjacent notches.

The method may comprise using a pair of interdigitated transverse stacks of rotary cutting blades wherein the notched blades are immediately adjacent one another in the interdigitated transverse stacks forming a first group of notched blades within the interdigitated transverse stacks such that the discontinuous slits are formed immediately adjacent one another.

The method may further comprise using a pair of interdigitated transverse stacks further comprising at least one (e.g. a plurality of) un-notched blade(s) for forming continuous slits in the web of plant material. The un-notched blades may be grouped together in the interdigitated transverse stack to form a group of continuous slits in the web of cannabinoid-containing (e.g. cannabis) plant material.

The method may comprise using a pair of interdigitated transverse stacks comprising a second group of notched blades immediately adjacent one another in the interdigitated transverse stack for forming a second group of discontinuous slits.

The group of un-notched blades may be interposed between the first and second group of notched blades.

The method may comprise using a pair of interdigitated transverse stacks wherein the plurality of notched blades are arranged within the interdigitated transverse stacks such that the angular spacing from a notch in a first blade within the interdigitated transverse stack progressively increases (e.g. by an equal amount) in a transverse direction along the stack (i.e. in the stacking direction of the blades). In this way the method comprises forming a plurality of diagonally arranged/diagonally offset discontinuities/transverse bridge portions.

The method may comprise using a pair of interdigitated transverse stacks wherein the plurality of notched blades are arranged within the interdigitated transverse stacks such that the angular spacing from a notch in a first blade within the interdigitated transverse stack alternately increases and decreases in a transverse direction along the stack (i.e. in the stacking direction of the blades). In this way the method comprises forming a plurality of discontinuities/transverse bridge portions which may be substantially randomly arranged or may form a plurality of longitudinally spaced diagonal arrangements which adjacent bridge portions forming part of different diagonal arrangements.

The method may comprise using a pair of interdigitated transverse stacks wherein the transverse spacing between adjacent blades in the stacks may be substantially equal.

The transverse spacing between the blades may be equal and may be equal to greater than 0.5 mm. The transverse spacing between the blades may be equal to or less than 2 mm, e.g. equal to or less than 1.5 mm. The transverse spacing between the blades may be around 1 mm.

Alternatively, the transverse spacing between the blades may vary across the transverse width such that there are shreds having differing transverse widths as described above.

The circumferential length of the notches (and thus the longitudinal dimension of the transverse bridge portions) may be equal to or greater than 1 mm, e.g. equal to or greater than 2 mm or 3 mm. In some embodiments, the circumferential length is equal to or less than 6 mm, e.g. equal to or less than 5 mm. In some embodiments, the circumferential length is around 4 mm.

The methods of the third aspect may be used to form a web of cannabinoid-containing (e.g. cannabis) plant material according to the second aspect.

In a fourth aspect there is disclosed a method for forming an aerosol-forming article, the method comprising:

- forming a web of cannabinoid-containing (e.g. cannabis) plant material using the method according to the third aspect;
- gathering the web to form a cylindrical rod;
- cutting the cylindrical rod to form a cylindrical aerosol-forming substrate; and
- circumscribing the aerosol-forming substrate using a wrapping layer.

The method may comprise forming the cylindrical rod having an axial length of around 120 mm and cutting the cylindrical rod to form an aerosol-forming substrate having an axial length of around 12 mm.

In some embodiments, the method may comprise forming a plurality of webs of plant material (e.g. two webs) where at least one is formed of cannabinoid-containing (e.g. cannabis) plant material (as described for the third aspect) and may further comprise combining the webs of plant material to form a cylindrical rod. In this respect, the plurality of webs of plant material may be gathered together so as to combine them. Each web of plant material may comprise shreds of single width, but that width may be different for each of the plurality of webs of plant material. In that respect, when the plurality of webs of plant material are combined to form the cylindrical rod, the rod may comprise a plurality of shreds having different widths.

In embodiments where the web comprises first and second shreds of different transverse widths, the gathering of the web of cannabinoid-containing (e.g. cannabis) plant material is performed so as to form a first region of the aerosol-forming article comprising a greater proportion of first shreds than second shreds.

In preferred embodiments gathering of the web of cannabinoid-containing (e.g. cannabis) plant material is performed such that the first region is at, or proximate to, the circumferential peripheral surface of the cylindrical aerosol-forming substrate when formed. For example, the web of cannabinoid-containing (e.g. cannabis) plant material may be arranged such that it has a greater proportion of first shreds (i.e. having a first transverse width) than second shreds (i.e. having a second transverse width) proximate to its longitudinal surface. The gathering may be such that the longitudinal surface (and regions proximate to this surface)

form the circumferential peripheral surface of the cylindrical rod (and subsequently form the circumferential surface of the substrate).

In a fifth aspect, there is provided a smoking substitute system comprising an aerosol-forming article according to the first aspect and a device comprising a heating element.

The device may be a HNB device i.e. a device adapted to heat but not combust the aerosol-forming substrate.

The device may comprise a main body for housing the heating element. The heating element may comprise an elongated e.g. rod, tube-shaped or blade heating element. The heating element may project into or surround a cavity within the main body for receiving the article/consumable described above.

The device (e.g. the main body) may further comprise an electrical power supply e.g. a (rechargeable) battery for powering the heating element. It may further comprise a control unit to control the supply of power to the heating element.

In a sixth aspect, there is provided a method of using a smoking substitute system according to the fifth aspect, the method comprising inserting the article/consumable into the device, and heating the article/consumable using the heating element.

In some embodiments, the method comprises inserting the article/consumable into a cavity within the main body and penetrating the article/consumable with the heating element upon insertion of the article/consumable. For example, the heating element may penetrate the aerosol-forming substrate in the article/consumable.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

SUMMARY OF THE FIGURES

So that the disclosure may be understood, and so that further aspects and features thereof may be appreciated, embodiments illustrating the principles of the disclosure will now be discussed in further detail with reference to the accompanying figures, in which:

FIGS. 7A and 7B show first and second embodiments of a web of cannabinoid-containing (e.g. cannabis) plant material that may be used together to form a substrate;

FIG. 8 shows a third embodiment of a web of cannabinoid-containing (e.g. cannabis) plant material that may be used to form a substrate;

FIG. 9 shows a fourth embodiment of a web of cannabinoid-containing (e.g. cannabis) plant material that may be used to form a substrate;

DETAILED DESCRIPTION OF THE FIGURES

Figure 1:
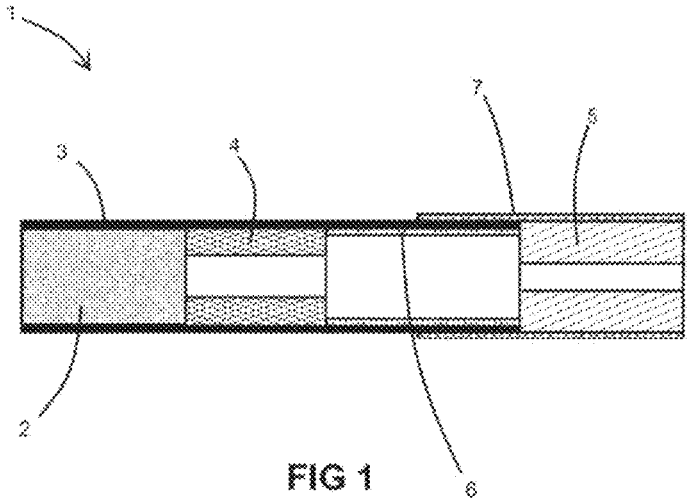
FIG. 1 shows a first embodiment of an HNB consumable.

As shown in FIG. 1, the HNB consumable 1 comprises an aerosol-forming substrate 2 at the upstream end of the consumable 1.

The aerosol-forming substrate comprises cannabis plant material which includes the cannabinoid CBD as a volatile compound.

The aerosol-forming substrate 2 comprises 65 wt % cannabis plant material which is provided in the form of gathered shreds produced from a sheet of slurry/paper recon cannabis.

Figure 6:
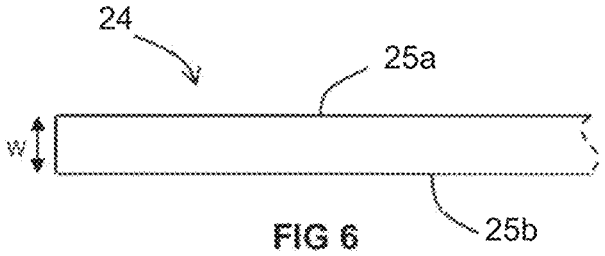
FIG. 6 shows an embodiment of a shred of cannabinoid-containing (e.g. cannabis) plant material.

Although not apparent from the figure, the substrate is formed of a plurality of longitudinally aligned elongate shreds of cannabis plant material. An exemplary portion of a shred of cannabis plant material 24 is shown (not to scale) in FIG. 6. The shred of cannabis plant material 24 comprises spaced longitudinal edges 25*a*, 25*b* and a transverse width W of the shred of cannabis plant material 24 is defined between the longitudinal edges 25*a*, 25*b*. The transverse width W of the shred of cannabis plant material 24 is generally consistent for the entire length of the shred 24.

The aerosol-forming substrate comprises a plurality of first shreds have a first transverse width W1 and a plurality of second shreds have a second transverse width W2 that is different from the first transverse width W1. The first and second shreds are distributed evenly throughout the substrate 2.

The aerosol-forming substrate 2 is formed in a substantially cylindrical shape such that the consumable resembles a conventional cigarette. It has diameter of around 7 mm and an axial length of around 12 mm.

The aerosol-forming substrate 2 is circumscribed by a paper wrapping layer 3.

The consumable 1 comprises an upstream hollow bore element 4 and a downstream terminal hollow bore element 5. The two elements 4, 5 are spaced by a cardboard spacer tube 6. Both elements 4, 5 are formed of cellulose acetate tow and wrapped with a respective paper plug layer (not shown).

Both elements 4, 5 have a substantially cylindrical shape. The diameter of the upstream hollow bore element 4 matches the diameter of the aerosol-forming substrate 2. The diameter of the terminal hollow bore element 5 is slightly larger and matches the combined diameter of the aerosol-forming substrate 2 and the wrapping layer 3. The upstream hollow bore element 4 is slightly shorter in axial length than the terminal hollow bore element 5 at an axial length of 10 mm compared to 12 mm for the terminal hollow bore element 5. The cardboard tube spacer 6 is longer having an axial length of around 14 mm.

Each hollow bore element 4, 5 has a hollow, longitudinally extending bore. The diameter of the bore in the upstream hollow bore element 4 is slightly larger than the diameter of the bore in the terminal hollow bore element 5 having a diameter of 3 mm compared to 2 mm for the terminal hollow bore element 5.

The cardboard spacer tube 6 and the upstream hollow bore element 4 are circumscribed by the wrapping layer 3.

The terminal hollow bore element 5 is joined to the adjacent, upstream elements forming the consumable by a circumscribing paper tipping layer 7. The tipping layer 7 encircles the terminal hollow bore element 5 and has an axial length of around 20 mm such that it overlays a portion of the cardboard tube spacer 6.

Figure 2:
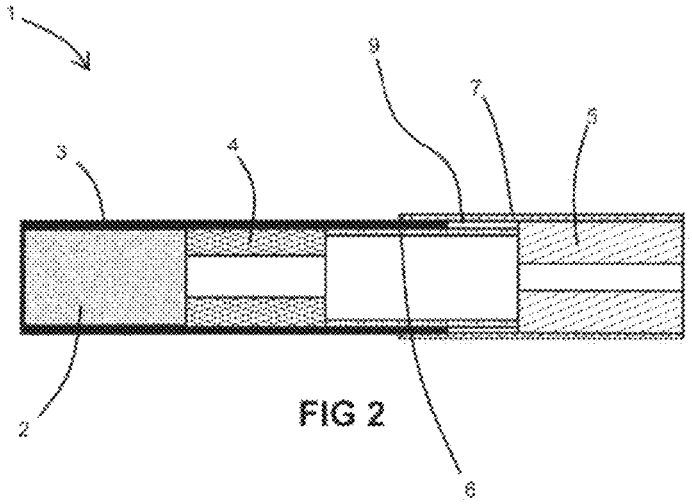
FIG. 2 shows a second embodiment of an HNB consumable.

FIG. 2 shows a second embodiment of a consumable 1" which is the same as the first embodiment except that the wrapping layer 3 does not completely circumscribe the cardboard spacer tube 6 such that there is an annular gap 9 between the tipping layer 7 and the cardboard spacer tube 6 downstream of the end of the wrapping layer 3.

Figure 3:
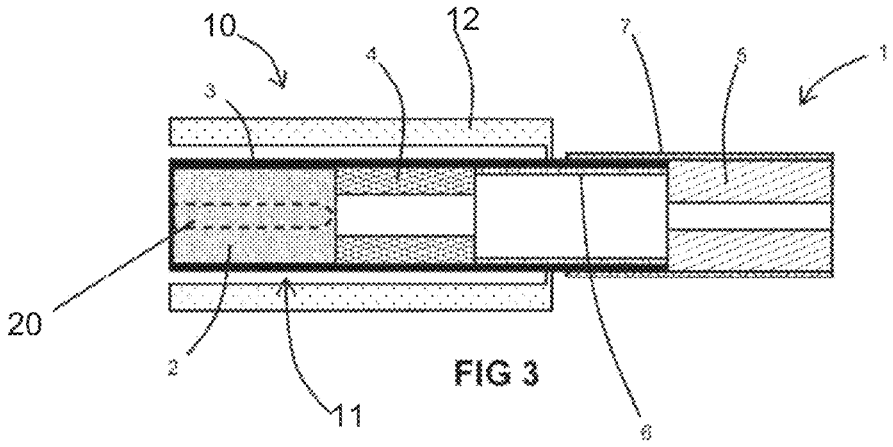
FIG. 3 shows the first embodiment within a device forming an HNB system.

FIG. 3 shows the first embodiment inserted into an HNB device 10 comprising a rod-shaped heating element 20 (shown in dashed lines). The heating element 20 projects into a cavity 11 within the main body 12 of the device.

The consumable 1 is inserted into the cavity 11 of the main body 12 of the device 10 such that the heating rod penetrates the aerosol-forming substrate 2. Heating of the reconstituted cannabinoid-containing (e.g. cannabis) plant material in the aerosol-forming substrate 2 is effected by powering the heating element 20 (e.g. with a rechargeable battery (not shown)). As the cannabis plant material is heated, moisture and volatile compound (e.g. CBD) within the cannabis plant material is released as a vapour and entrained within an airflow generated by inhalation by the user at the terminal hollow bore element 5.

As the vapour cools within the upstream hollow bore element 4 and the cardboard spacer tube 6, it condenses to form an aerosol containing the volatile compounds for inhalation by the user.

Figure 4:
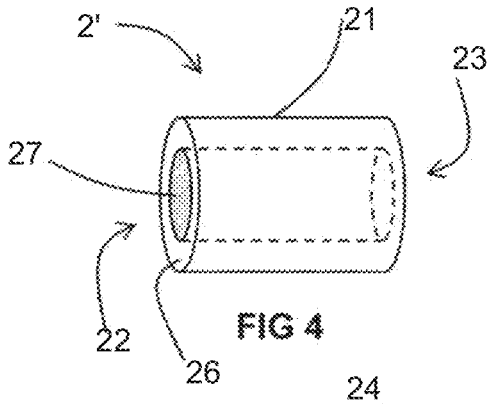
FIG. 4 shows a first embodiment of a substrate that may form part of a HNB consumable.

FIG. 4 depicts an embodiment of an aerosol-forming substrate 2'. As may be apparent, the substrate 2' may form a part of any one of the articles/consumables described above and shown in FIGS. 1 to 3. The consumable 2' comprises a generally cylindrical form having a circumferential surface 21 extending between first (upstream) 22 and second (downstream) 23 ends. Although not apparent from the figure, the substrate is formed of a plurality of shreds of cannabis plant material. An exemplary portion of a shred of cannabis plant material 24 is shown (not to scale) in FIG. 6. The shred of cannabis plant material 24 comprises spaced longitudinal edges 25*a*, 25*b* and a transverse width W of the shred of cannabis plant material 24 is defined between the longitudinal edges 25*a*, 25*b*. The transverse width W of the shred of cannabis plant material 24 is generally consistent for the entire length of the shred 24.

Returning to FIG. 4, the plurality of longitudinally aligned shreds of cannabis plant material (that form the substrate 2') comprises first shreds and second shreds. The first shreds have a first transverse width W1 and the second shreds have a second transverse width W2 that is different from the first transverse width W1. In the presently illustrated embodiment, the first and second shreds are not distributed evenly throughout the substrate. Rather, the substrate comprises first region 26 and second region 27 that differ with respect to their distribution of first and second shreds.

The first region 26 extends circumferentially at a periphery of the substrate 2' (i.e. at the circumferential surface 21), so as to have a donut shaped transverse cross-sectional profile. This first region 26 has a greater proportion (e.g. by volume, number, and/or weight) of first shreds than of the second shreds. The first region 26 may, for example, only include first shreds of the first shreds. Where the first transverse width W1 is larger than the second transverse width W2, the first region 26 is predominantly formed of larger-width shreds.

The second region 27 extends along a central longitudinal axis of the substrate 2' so as to define a central core of the substrate 2' (surrounded by the first region). In contrast to the first region, the second region comprises a greater proportion (e.g. by volume, number and/or weight) of second shreds than of the first shreds. The second region 27 may only include second shreds. Assuming again that first transverse width W1 is larger than the second transverse width W2, the second region 27 is predominantly made up of smaller-width shreds.

By having larger width shreds at its periphery, and smaller width shreds at its centre, the substrate 2' may have different heat transfer characteristics than a substrate containing a single shred type. For example the second region may have a higher rate of heat transfer than the first region.

Figure 5:
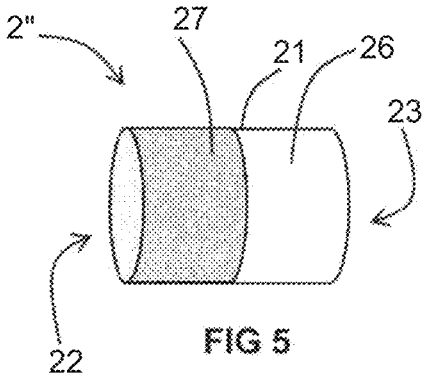
FIG. 5 shows a second embodiment of a substrate that may form part of a HNB consumable.

FIG. 5 depicts a further embodiment of a substrate 2" that again comprises a first region 26 having a greater proportion of first shreds (comprising a first transverse width W1) and a second region 27 having a greater proportion of second shreds. However, in this case, the regions 26, 27 are arranged so as to be axially adjacent to one another. Thus, the proportion of first and second shreds varies axially rather than radially (as is the case with the embodiment shown in FIG. 4).

FIGS. 7A and 7B depict webs of cannabis plant material 28A, 28B for forming an aerosol forming substrate. Each of the webs 28A, 28B comprises a plurality of longitudinally extending shreds. Each web 28A, 28B is formed of a sheet of homogenized cannabis plant material e.g. a sheet of paper recon or slurry recon cannabis which is slit by passing it longitudinally between a pair of interdigitated transverse stacks of spaced apart rotary cutting blades. The blades cut a plurality of longitudinally-extending slits 29*a*, 29*b*, 29*c*, etc. in the sheet, thus forming the web 28A, 28B. As is indicated by the dashed lines, each web 28A, 28B may extend indefinitely in the longitudinal direction.

The web 28A shown FIG. 7A comprises first shreds 30*a*, 30*b*, 30*c*, etc. that each have a transverse width W1 of 1 mm. Such shreds 30*a*, 30*b*, 30*c* may be formed by interdigitated transverse stacks of rotary cutting blades (as discussed above) spaced apart by 1 mm. On the other hand, the web 28B shown in FIG. 7B comprises second shreds 31*a*, 31*b*, 31*c*, etc. that each have a transverse width W2 of 2 mm. Again, such shreds 31*a*, 31*b*, 31*c* may be formed by interdigitated transverse stacks of rotary cutting blades (as discussed above) spaced apart by 2 mm.

As will be discussed in more detail below, the shreds of the webs 28A, 28B may gathered to form an aerosol forming substrate. In this respect, the aerosol-forming substrate would comprise a plurality of first shreds of 1 mm transverse width W1 (from the web of FIG. 7A) and a plurality of second shreds of 2 mm transverse width W2 (from the web of FIG. 7B).

FIG. 8 shows a further embodiment of a web of cannabis plant material 28C comprising first and second shreds. The first shreds 30*a*, 30*b*, 30*c*, etc. have a transverse width W1 of 1 mm and the second shreds 31*a*, 31*b*, 31*c*, etc. have a transverse width W2 of 2 mm. As is apparent from the figure, the first shreds 30*a*, 30*b*, 30*c* are interspersed with the second shreds 30*a*, 30*b*, 30*c*. In particular, the pattern of shreds (progressing transversely across the web) alternates between a single second shred 31*a* and two first shreds 30*a*, 30*b*. This web 28C may also be formed by way of interdigitated transverse stacks of spaced apart rotary cutting blades (as discussed above), but in this case the cutting blades are not evenly spaced. Rather, the cutting blades are arranged in groups of three 1 mm spaced cutting blades, with the groups of cutting blades spaced from one another by 2 mm.

Like the previously described webs 28, 28B, this web 28C can be gathered to form an aerosol-forming substrate. However, rather than forming this substrate from two separate webs, only a single web 28C of the present embodiment is required to form the aerosol-forming substrate comprising first shreds 30*a*, 30*b*, 30*c* and second shreds 31*a*, 31*b*, 31*c* of two different transverse widths W1, W2. As may be apparent from the figure, an aerosol-forming substrate formed from the present web 28C would have (approximately) an even distribution (e.g. by weight or volume) of shreds 30*a*, 30*b*, 30*c* of 1 mm transverse width and shreds 31*a*, 31*b*, 31*c* of 2 mm transverse width.

FIG. 9 shows a further embodiment of a web 28D of cannabis plant material. Like the embodiment shown in FIG. 8, this embodiment comprises first and second shreds of 1 mm transverse width and 2 mm transverse width respectively. However, the distribution of the first and second shreds is different to that previously described. In the present embodiment the second shreds 31*a*, 31 *b*, 31*c* are distributed at the longitudinal edges 32 of the web 28D and the first shreds 30*a*, 30*b*, 30*c* are sandwiches between the second shreds at a central region of the web 28D. Again, this web 28D may also be formed by way of interdigitated transverse stacks of spaced apart rotary cutting blades. In this case, there are two groups of two 2 mm spaced cutting blades (for forming the second shreds) and a single group of 1 mm spaced cutting blades (for forming the first shreds) disposed intermediate the two 2 mm groups and spaced from those groups by 2 mm. When this web 28D is gathered the first shreds will be bundled together in a core region at the axial centre of the substrate 2".

Figure 10:
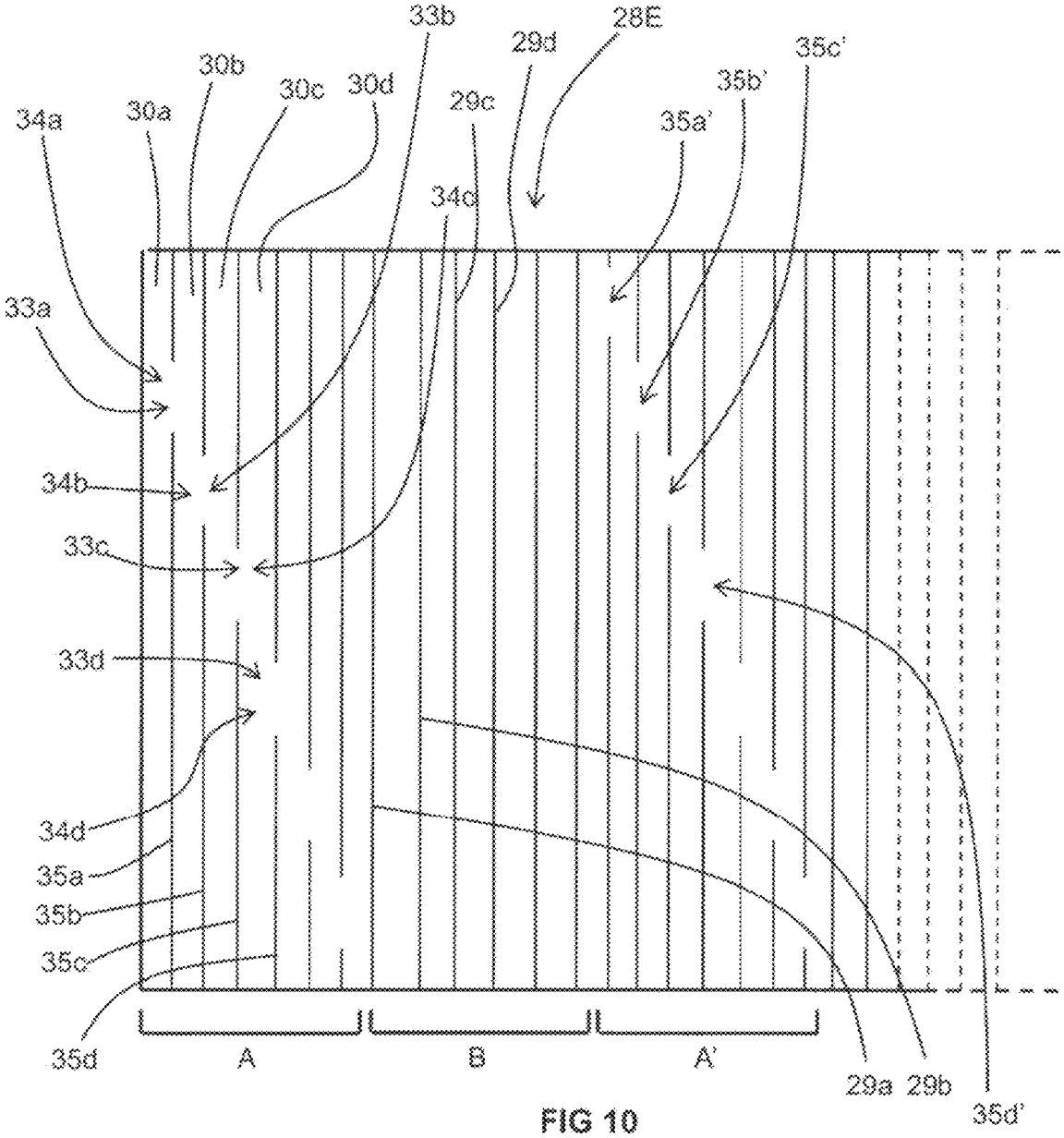
FIG. 10 shows a fifth embodiment of a web of cannabinoid-containing (e.g. cannabis) plant material that may be used to form a substrate.

FIG. 10 shows a further embodiment of a web 28E of cannabis plant material having a plurality of longitudinally-extending shreds 30*a*, 30*b*, 30*c*, 30*d* etc. Each shred has a transverse width of 1 mm.

The shreds 30*a*, 30*b*, 30*c*, 30*d* etc. are formed of a sheet of homogenized cannabis e.g. a sheet of paper recon or slurry recon cannabis which is slit by passing it longitudinally between a pair of interdigitated transverse stacks of rotary cutting blades with the blades equally spaced apart by 1 mm. The blades cut a plurality of longitudinally-extending discontinuous slits 35*a*, 35*b*, 35*c*, 35*d* etc. in the sheet thus forming the web 28E.

A plurality of blades within the interdigitated transverse stacks each comprise a respective notch having a circumferential extension of 4 mm and the notches are circumferentially staggered relative to one another i.e. angularly spaced in a circumferential direction relative to one another. The notches are completely unaligned in the circumferential direction meaning that there is no overlap of the notches in the circumferential direction.

As the sheet of reconstituted cannabis passes longitudinally through the interdigitated stacks of rotating blades, each notch will result in a longitudinal discontinuity 33*a*, 33*b*, 33*c*, 33*d* etc. of 4 mm in the slits 35*a*, 35*b*, 35*c*, 35*d* etc. These discontinuities in the slits 35*a*, 35*b*, 35*c*, 35*d* create transverse bridge portions 34*a*, 34*b*, 34*c*, 34*d* of un-slit cannabis sheet which span two adjacent shreds. Thus each bridge portion 34*a*, 34*b*, 34*c*, 34*d* has a transverse width of 2 mm and a longitudinal length of 4 mm.

The discontinuities 33*a*, 33*b*, 33*c*, 33*d*/transverse bridge portions 34*a*, 34*b*, 34*c*, 34*d* are off-set from one another by a longitudinal spacing which will equal the circumferential spacing of the adjacent notches on the adjacent rotary cutting blades. Thus it can be seen that there is no bridge portion extending across the entire transverse width of the web 28E. Each bridge portion 34*a*, 34*b*, 34*c*, 34*d* spans only two adjacent shreds and adjacent bridge portions are completely unaligned in the transverse direction.

In the embodiment shown in FIG. 10, the discontinuous slits 35*a*, 35*b*, 35*c*, 35*d* are immediately adjacent one another and form a first group A of discontinuous slits.

The web 28 further comprises a second group A' of discontinuous slits 35*a*', 35*b*', 35*c*', 35*d*' etc. which are transversely spaced from the first group A of discontinuous slits 35*a*, 35*b*, 35*c*, 35*d* etc. by a group B of continuous slits 29*a*, 29*b*, 29*c*, 29*d*, etc. (i.e. slit(s) without any discontinuities/transverse bridge portions). The continuous slits 29*a*, 29*b*, 29*c*, 29*d* are formed by including adjacent un-notched blades within the interdigitated transverse stack of blades.

As can be seen in FIG. 10, the longitudinal spacing between adjacent discontinuities 33*a*, 33*b*, 33*c*, 33*d* and bridge portions 34*a*, 34*b*, 34*c*, 34*d*, etc. is equal (arising from an equal angular spacing of the notches on the blades) such that the discontinuities 33*a*, 33*b*, 33*c*, 33*d* and bridge portions 34*a*, 34*b*, 34*c*, 34*d*, are diagonally off-set on the web.

Figure 11:
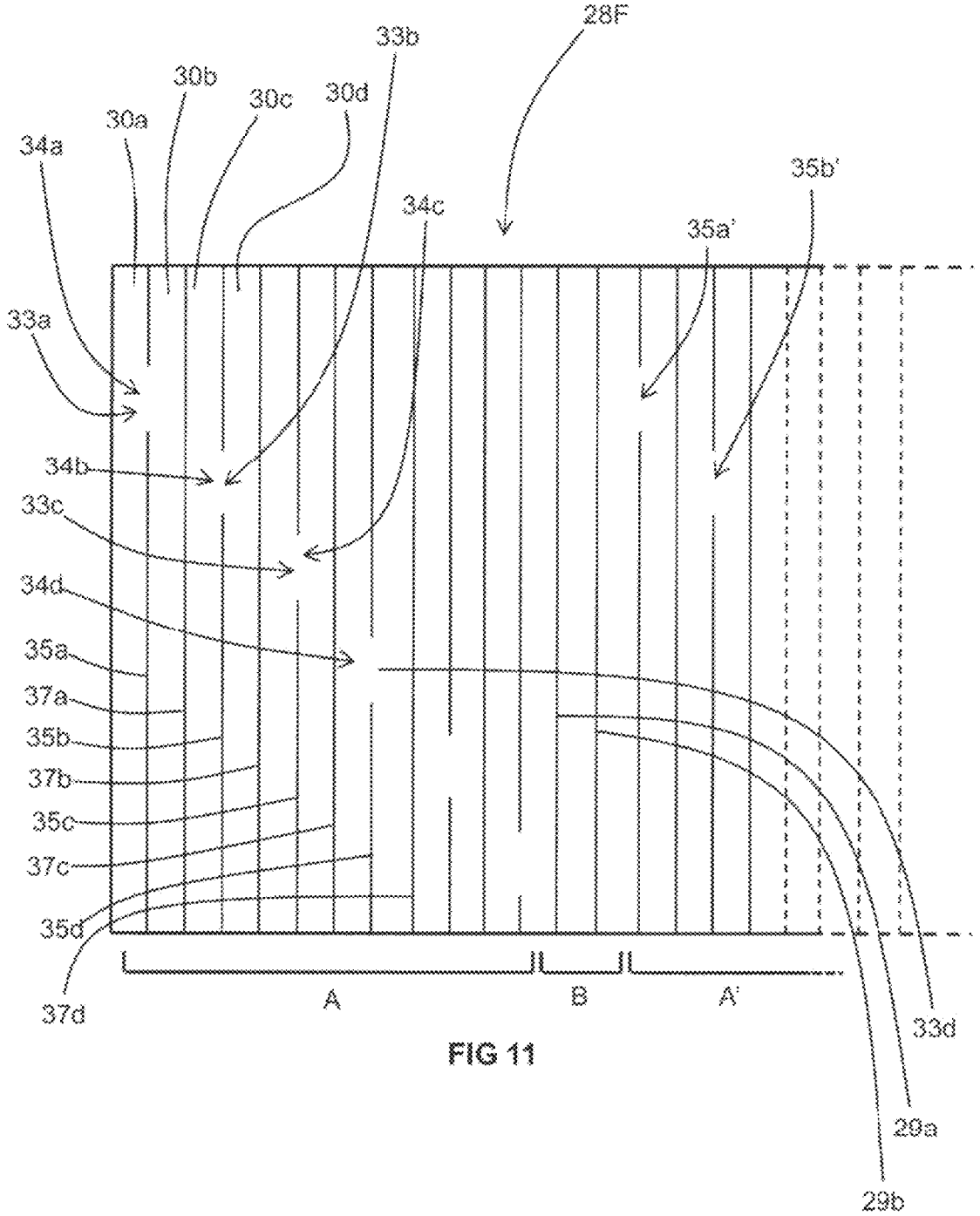
FIG. 11 shows a sixth embodiment of a web of cannabinoid-containing (e.g. cannabis) plant material that may be used to form a substrate.

The web 28F shown in FIG. 11 is substantially the same as that shown in FIG. 10 except that there are continuous slits 29*a*, 29*b*, 29*c*, 29*d* etc. interposed between adjacent discontinuous slits 35*a*, 35*b*, 35*c*, 35*d* in the first group A of discontinuous slits.

The group B of continuous slits 29*a*, 29*b* shown in FIG. 11 has a smaller transverse dimension (i.e. there are fewer continuous slits) but this group B of continuous slits may be increased in size (i.e. may contain a greater number of continuous slits).

Figure 12:
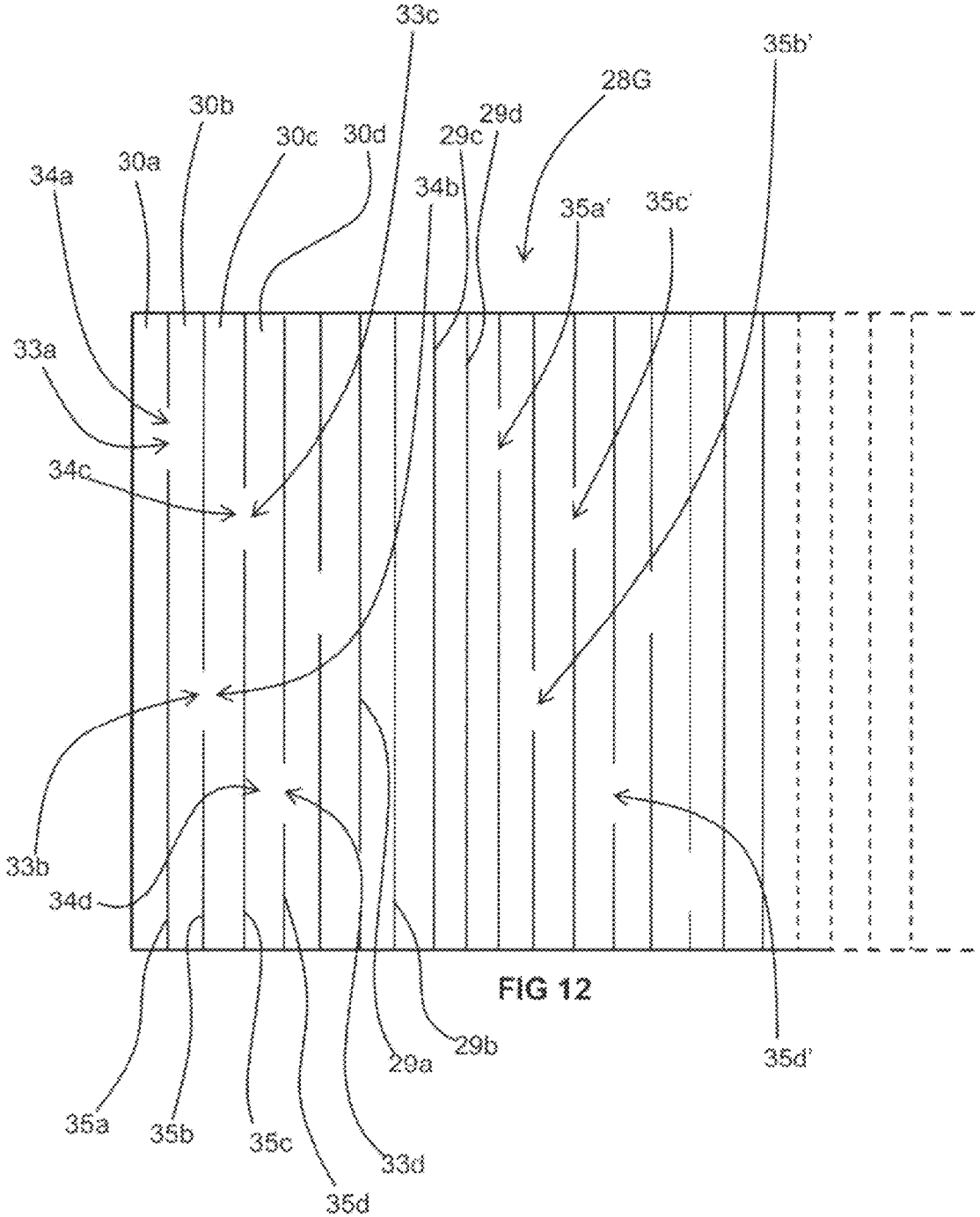
FIG. 12 shows a seventh embodiment of a web of cannabinoid-containing (e.g. cannabis) plant material that may be used to form a substrate.

FIG. 12 shows a seventh embodiment of a web 28G which is the same as the fifth embodiment in FIG. 10 except that the discontinuous slits 35*a*, 35*b*, 35*c*, 35*d* are formed by feeding the sheet longitudinally through a pair of interdigitated transverse stacks of notched blades which are arranged such that the angular spacing from a notch in a first blade within the interdigitated transverse stack alternately increases and decreases in a transverse direction along the stack (i.e. in the stacking direction of the blades). This results in a plurality of discontinuities 33*a*, 33*b*, 33*c*, 33*d* transverse bridge portions 34*a*, 34*b*, 34*c*, 34*d* arranged so as to form two longitudinally staggered diagonal arrangements within the group of group of discontinuous slits 35*a*, 35*b*, 35*c*, 35*d*.

Figure 13:
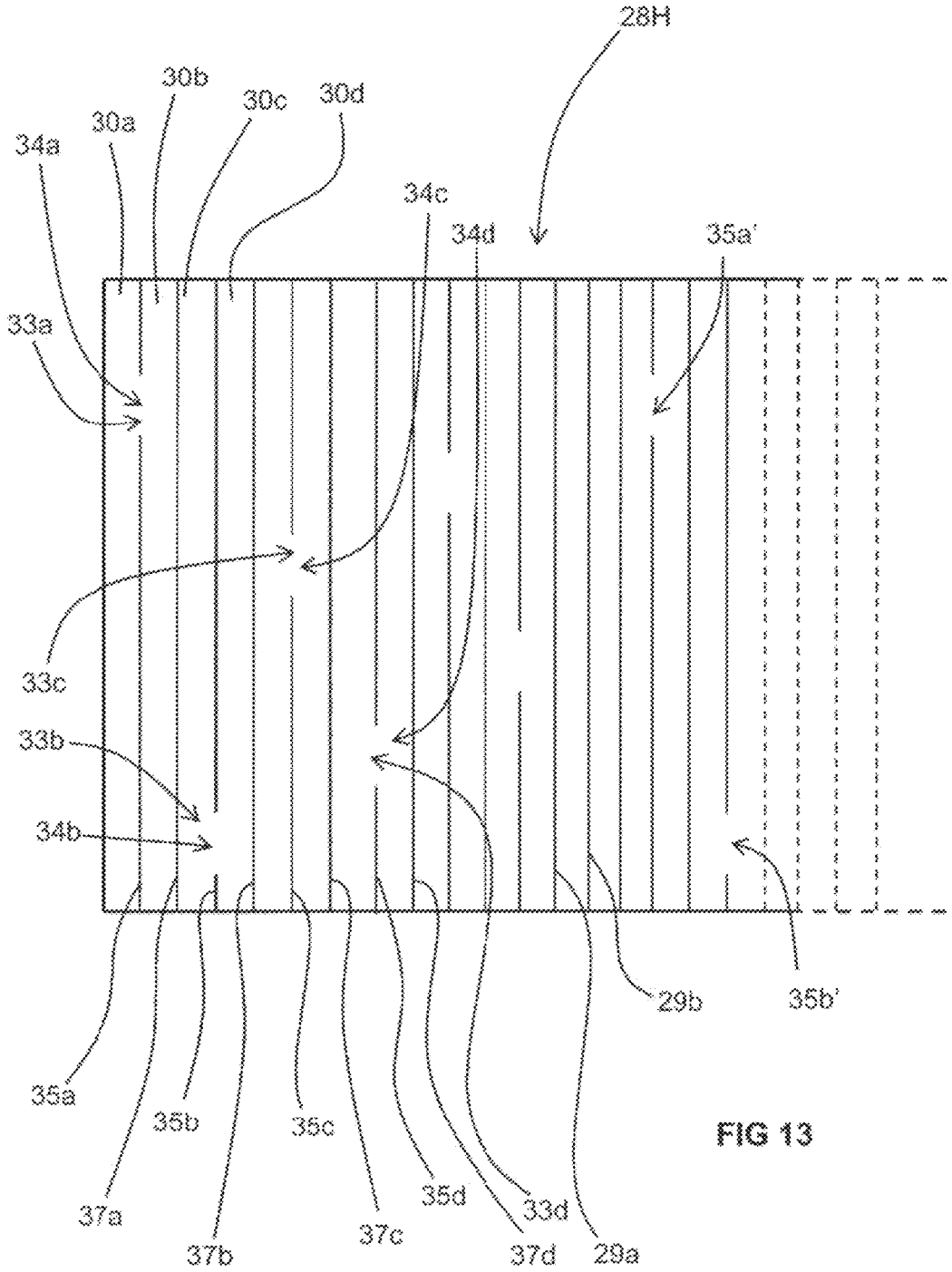
FIG. 13 shows an eighth embodiment of a web of cannabinoid-containing (e.g. cannabis) plant material that may be used to form a substrate.

FIG. 13 shows an eighth embodiment of a web 28H, which includes additional continuous slits 37*a*, 37*b*, 37*c*, 37*d* interposed between the discontinuous slits 35*a*, 35*b*, 35*c*, 35*d*. Like the embodiment shown in FIG. 12, the web 28H is formed by feeding the sheet longitudinally through a pair of interdigitated transverse stacks of notched blades which are arranged such that the angular spacing from a notch in a first blade within the interdigitated transverse stack alternately increases and decreases in a transverse direction along the stack (i.e. in the stacking direction of the blades). However, in this embodiment of the web 28H the resulting bridge portions are randomly arranged within the group of discontinuous slits 35*a*, 35*b*, 35*c*, 35*d*.

Any of the webs shown in the FIGS. 7A/B to 13 may be being gathered in a transverse direction to form a cylindrical rod of longitudinally-aligned, elongate shreds of cannabis plant material having a diameter of around 7 mm. The rod may be cut to the desired length (e.g. 12 mm) and at least partially circumscribed by a wrapping layer to form a heat-not-burn (HNB) consumable.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the scope of the disclosure.

For the avoidance of any doubt, any theoretical explanations provided herein are provided for the purposes of improving the understanding of a reader. The inventors do not wish to be bound by any of these theoretical explanations.

Throughout this specification, including the claims which follow, unless the context requires otherwise, the words "have", "comprise", and "include", and variations such as "having", "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means, for example, +/−10%.

The words "preferred" and "preferably" are used herein refer to embodiments of the disclosure that may provide certain benefits under some circumstances. It is to be appreciated, however, that other embodiments may also be preferred under the same or different circumstances. The recitation of one or more preferred embodiments therefore does not mean or imply that other embodiments are not useful, and is not intended to exclude other embodiments from the scope of the disclosure, or from the scope of the claims.

The invention claimed is:

1. An aerosol-forming article comprising an aerosol-forming substrate formed of a plurality of longitudinally-aligned, elongate shreds of plant material;

wherein the aerosol-forming substrate comprises a plurality of first elongate shreds and a plurality of second elongate shreds, each first shred having longitudinal edges spaced by a first transverse width and each second shred having longitudinal edges spaced by a second transverse width, wherein the first transverse width is different to the second transverse width, wherein a region of the aerosol-forming substrate comprises a greater proportion of first shreds than second shreds, wherein there is a plurality of transverse bridge portions each extending between and joining two or more of the shreds.

2. An aerosol-forming article according to claim 1 wherein the aerosol-forming substrate comprises one or more cannabinoid compounds selected from cannabidiol (CBD) and its derivatives/homologues, cannabigerol (CBG) and its derivatives/homologues, cannabinol (CBN) and its derivatives/homologues, tetrahydrocannabinol (THC) and its derivatives/homologues, cannabicyclol (CBL) and its derivatives/homologues, cannabichromene (CBC) and its derivatives/homologues, cannabielsoin (CBE) and its derivatives/homologues, and cannabicitran (CBT) and its derivatives/homologues.

3. An aerosol-forming article according to claim 1 wherein the plant material comprises at least one cannabinoid, and wherein the cannabinoid-containing plant material comprises cannabis plant material.

4. An aerosol-forming article according to claim 3 wherein the plant material comprises slurry or paper reconstituted cannabis plant material.

5. An aerosol-forming article according to claim 1 wherein the aerosol-forming article is a heat-not-burn (HNB) consumable.

6. An aerosol-forming article according to claim 1 wherein the region of the aerosol-forming substrate is a first region, and wherein the aerosol-forming substrate comprises a second region, the second region of the aerosol-forming substrate comprises a greater proportion of second shreds than of the first shreds and wherein the first region is disposed at a periphery of the aerosol-forming substrate and the second region is disposed at a central portion of the aerosol-forming substrate, which is spaced from the periphery of the aerosol-forming substrate.

7. An aerosol-forming article according to claim 1 wherein each transverse bridge portion spans ten or fewer immediately adjacent shreds of cannabinoid-containing plant material.

8. The aerosol-forming article of claim 1 wherein ratio of the greater of the first and second transverse width to the lesser of the first and second transverse width is between 1.5:1 and 3:1.

* * * * *